US007417595B2

(12) United States Patent
Jones

(10) Patent No.: US 7,417,595 B2
(45) Date of Patent: Aug. 26, 2008

(54) MOUNT ASSEMBLY FOR TWO-WAY RADIO ANTENNA

(76) Inventor: Richard T. Jones, 516 Bankhead Hwy., Carrollton, GA (US) 30117

( * ) Notice: Subject to any disclaimer, the term of this patent is extended or adjusted under 35 U.S.C. 154(b) by 19 days.

(21) Appl. No.: 11/701,847

(22) Filed: Feb. 2, 2007

(65) Prior Publication Data

US 2007/0182652 A1 Aug. 9, 2007

Related U.S. Application Data

(60) Provisional application No. 60/766,660, filed on Feb. 3, 2006.

(51) Int. Cl.
*H01Q 1/32* (2006.01)

(52) U.S. Cl. ..... 343/715; 343/888

(58) Field of Classification Search ..... 343/711, 343/713, 715, 878, 888, 889, 900
See application file for complete search history.

(56) References Cited

U.S. PATENT DOCUMENTS 2,917,743 A * 12/1959 Grashow ..... 343/713
3,100,241 A * 8/1963 Goldstein ..... 174/138 A
4,431,332 A * 2/1984 Dieges ..... 403/252
5,583,522 A * 12/1996 Radomski et al. ..... 343/715

* cited by examiner

*Primary Examiner*—Hoang V Nguyen
(74) *Attorney, Agent, or Firm*—Adams & Wilks

(57) ABSTRACT

A mount assembly for mounting a two-way radio antenna to a curved section of a vehicle has top and bottom collars shaped to match the contour of the vehicle curved section. During installation of the mount assembly, the top and bottom collars are positioned on opposite sides of the vehicle curved section, and an externally-threaded tubular connector is inserted through through-holes in the top and bottom collars and through an opening formed in the curved section of the vehicle. A mounting ring threads onto the upper end of the tubular connector that projects beyond the top collar and is threaded into engagement with the upper surface of the top collar. A fastening nut threads onto the lower end of the tubular connector that projects beyond the lower surface of the bottom collar. As the fastening nut is tightened, the top and bottom collars are drawn together to firmly secure the mount assembly to the vehicle surface. A two-way radio antenna is threaded onto external threads provided on the mounting ring, thereby attaching the antenna in a vertical orientation to the vehicle through the mount assembly.

20 Claims, 3 Drawing Sheets

MOUNT ASSEMBLY FOR TWO-WAY RADIO ANTENNA

CROSS REFERENCE TO RELATED APPLICATION

This application claims the benefit of U.S. Provisional Application No. 60/766,660, filed Feb. 3, 2006.

BACKGROUND OF THE INVENTION

The present invention relates to a mount assembly for mounting a two-way radio antenna to a mobile vehicle, and more particularly relates to a heavy duty mount assembly for securely mounting a two-way radio antenna to a curved surface of a mobile vehicle, such as a vehicle fender, so that the antenna extends perpendicularly to the ground along which the vehicle travels.

Two-way radios are in widespread use today by policemen, firemen, EMS personnel, security personnel, commercial personnel, military personnel and many others. To facilitate two-way radio communication, it is often necessary to mount a two-way radio antenna on a mobile vehicle. Many antenna mounts have been developed for this purpose.

Many standard antenna mounts that are commercially available today attach to the fender of a vehicle using small fingers that grip the underside of the vehicle fender. Such antenna mounts are disadvantageous because they provide a relatively weak mount assembly which is easily dislodged. Also, such antenna mounts have an open area between the coaxial cable shield and the mount itself, which is disadvantageous because RF energy escapes through the open area causing degradation of radio signals. Moreover, such antenna mounts, while easily mountable to a flat surfaces of a vehicle, are not readily mountable to curved surfaces. Furthermore, many of the standard antenna mounts are not designed to mount the radio antenna so that it extends perpendicularly to the ground, which is necessary for maximizing transmission and reception of RF energy.

Other antenna mounts that are commercially available are difficult to install, often requiring a skilled technician for installation, and many have a large number of parts and thus are costly to manufacture and time-consuming to install. In addition, many commercially available antenna mounts present a small contact area between the mount and the vehicle surface to which it is mounted, which results in a lack of mount stability and the likelihood that the antenna will become loosened over time and even jarred out of position when the vehicle rides over bumpy surfaces.

SUMMARY OF THE INVENTION

Accordingly, it is a principal object of the present invention to provide a mount assembly for a two-way radio antenna that overcomes the foregoing drawbacks.

Another object of the present invention is to provide a mount assembly for a two-way radio antenna that provides a strong and stable attachment of the antenna to a vehicle surface.

Another object of the present invention is to provide a mount assembly for a two-way radio antenna that enables mounting of the antenna on a curved section of a vehicle while positioning the antenna in a vertical orientation.

A further object of the present invention is to provide a mount assembly for a two-way radio antenna that is inexpensive to manufacture, easy to install and durable in construction.

Yet another object of the present invention is to provide a mount assembly for a two-way radio antenna that provides a large contact area to rigidify and strengthen attachment of the antenna to a vehicle surface.

A still further object of the present invention is to provide a mount assembly for a two-way radio antenna that is devoid of open areas that would permit leakage of radio energy.

These as well as other objects of the present invention are achieved by a mount assembly having top and bottom collars shaped to match the contour of a curved section of a vehicle and, during installation of the mount assembly, are positioned on opposite sides of the vehicle curved section. An externally-threaded tubular connector is insertable through through-holes in the top and bottom collars and through an opening formed in the curved section of the vehicle. A mounting ring threads onto the upper end of the tubular connector that projects beyond the top collar and is threaded into engagement with the upper surface of the top collar. A nut threads onto the lower end of the tubular connector that projects beyond the lower surface of the bottom collar. As the nut is tightened, the top and bottom collars are drawn together to firmly secure the mount assembly to the vehicle surface. A two-way radio antenna can then be threaded onto external threads provided on the mounting ring, thereby attaching the antenna to the vehicle through the mount assembly.

The tubular connector is formed of electrically conductive material. An electrically insulative sleeve extends lengthwise through the tubular connector, and a center conductor extends lengthwise through the sleeve. The opposite ends of the center conductor terminate in sockets. To enable electrical connection of the antenna to the mount assembly, an electrically conductive center pin is inserted through the center opening in the mounting ring into the upper socket of the center conductor and constitutes a center contact that makes electrical contact with a center contact of the antenna. The mounting ring constitutes a ground contact and is maintained at the ground potential of the vehicle through an electrical path established between the mounting ring, the tubular connector and the metal vehicle surface as well as through an electrical path established between the metal ring, the tubular connector and the ground terminal of a coaxial connector which is threaded onto the lower end of the tubular connector and which is connected through the radio circuitry to the ground potential of the vehicle.

The bottom collar is formed of electrically conductive material and, when the mount assembly is installed on the vehicle, tightly contacts the underside of the vehicle curved section. The tubular connector is dimensioned to contact the peripheral surfaces of the through-holes formed in the top and bottom collars so that the bottom collar also functions to electrically ground the mounting ring, and hence the antenna, to ground potential. The upper surface of the bottom collar is preferably roughened, such as by grooves, to enhance the electrical connection between the bottom collar and the underside of the vehicle curved section. The provision of such grooves also enables the upper surface of the bottom collar to bite into the underside of the vehicle curved section thereby enhancing the gripping action between the bottom collar and the vehicle.

The above and further objects, features, and advantages of the present invention will become clear from a reading of the following detailed description of the invention in conjunction with the accompanying drawings.

DETAILED DESCRIPTION OF THE INVENTION

For illustrative purposes, the mount assembly of the present invention will be described with reference to installation thereof on a curved fender of a vehicle. The mount assembly of the invention is not, of course, limited to installation on a vehicle fender and may be installed on other suitable curved sections of a vehicle, including the roof, trunk, side panels and the like.

Figure 1:
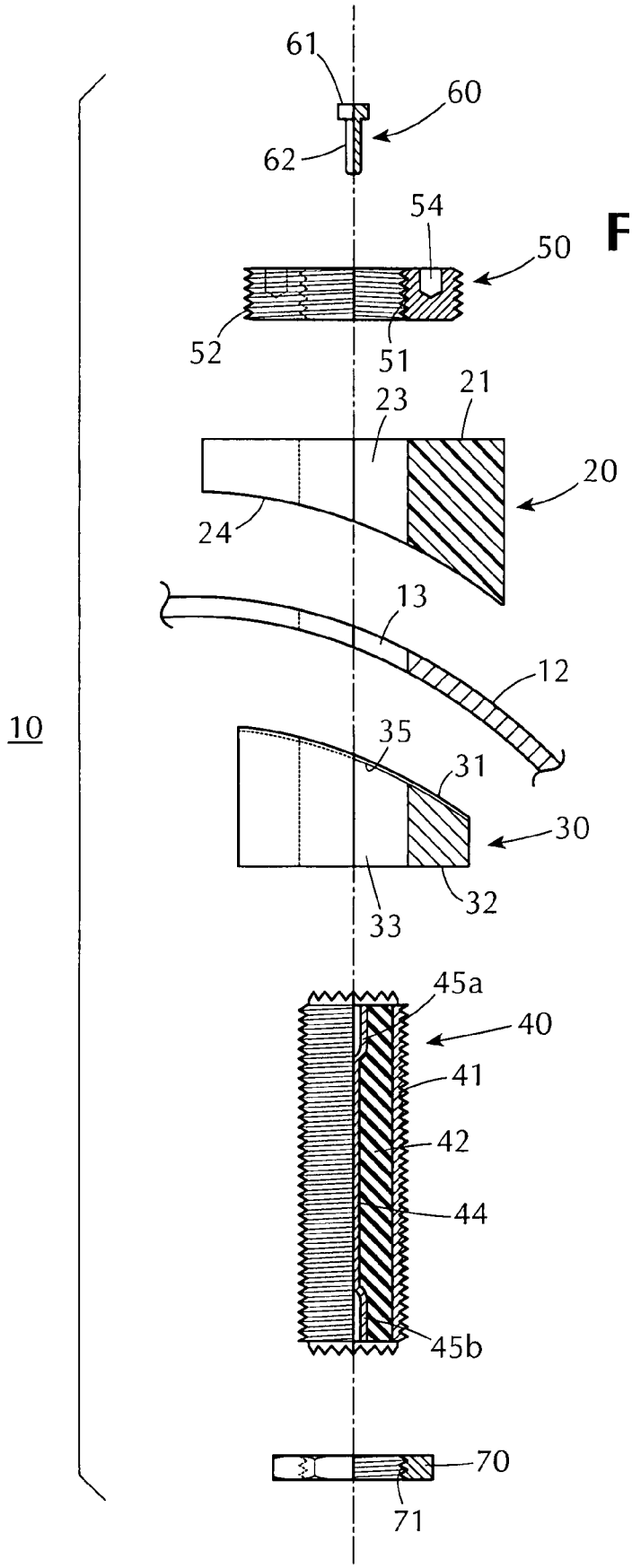
FIG. 1 is an exploded view, partly in cross section, showing the mount assembly of the present invention in a disassembled state.

For explanatory purposes, the parts in FIG. 1 are shown in cross section on the right-hand side of a vertical center line and shown in full view on the left-hand side of the center line. In the assembled state of the mount assembly shown in FIG. 3, the parts are shown partly in section.

Figure 3:
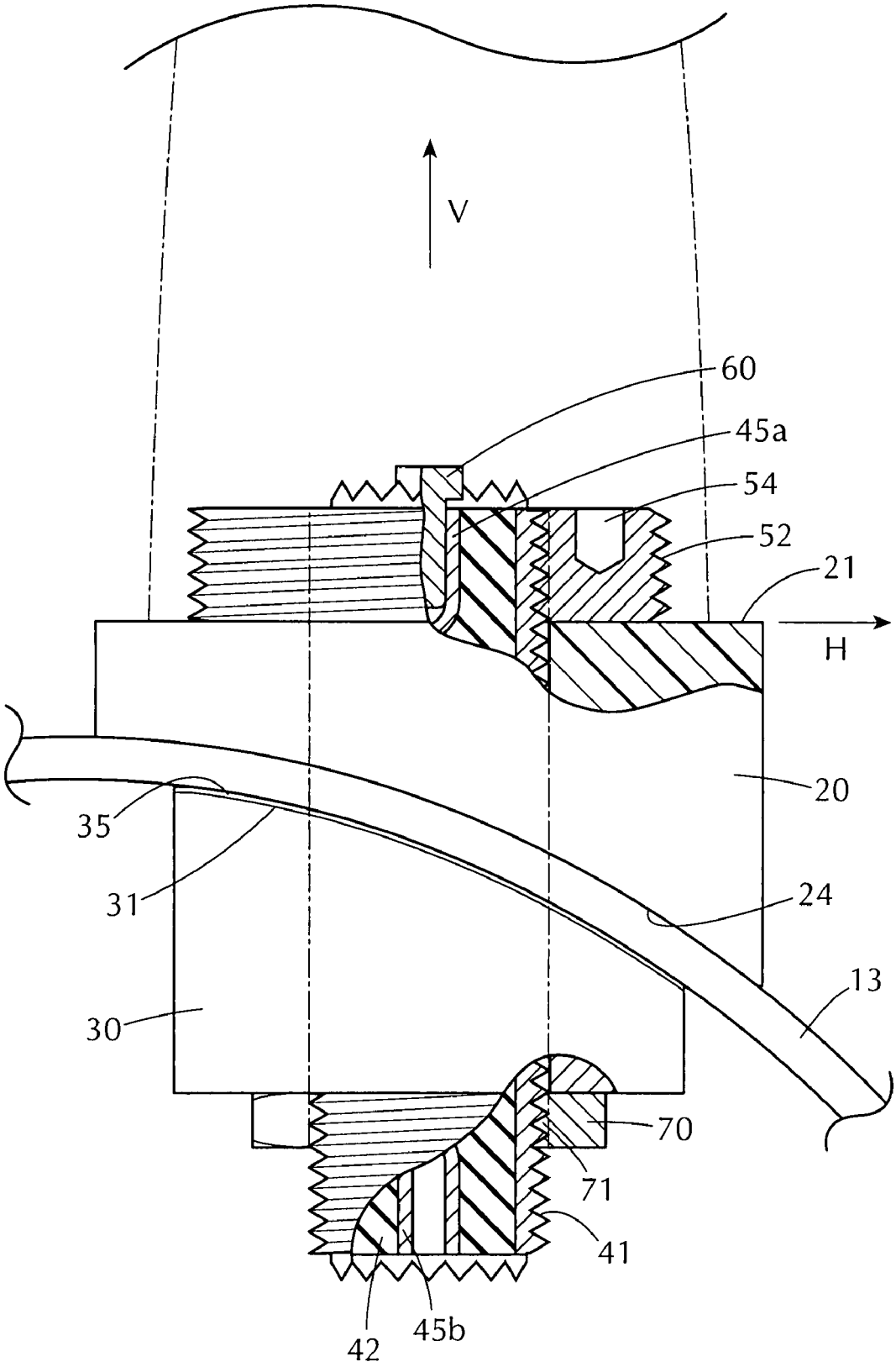
FIG. 3 is a side view, partly in section, showing the mount assembly in an assembled state installed on a vehicle.

The major parts of a mount assembly 10 for a two-way radio antenna are shown in an unassembled state in FIG. 1 and in an assembled state in FIG. 3. For illustrative purposes only, the mount assembly 10 will be described with reference to attachment thereof to a curved fender 12 of a vehicle as an illustrative example of one type of curved surface on which the mount assembly can be installed. The invention is not limited to installation on a curved section of a fender and is equally applicable to installation on any other suitable curved section of a vehicle.

The mount assembly 10 comprises a top collar 20 and a bottom collar 30. The top collar 20 has a flat upper surface 21, a curved lower surface 22, and a through-hole 23 that extends through the top collar from the upper surface 21 to the lower surface 22. The bottom collar 30 has a curved upper surface 31, a flat lower surface 32, and a through-hole 33 that extends through the bottom collar 30 from the upper surface 31 to the lower surface 32. The top collar 20 may be formed of any suitable material having rigidity, strength and weather resistance, such as high density plastic, brass, copper, aluminum or the like. The bottom collar 30 may likewise be formed of any suitable material having rigidity, strength and weather resistance, preferably electrically conductive material to facilitate electrical grounding of the antenna (shown in broken lines in FIG. 3), such as brass, copper, aluminum or the like. Both collars 20 and 30 may be formed by machining suitable blocks of material and drilling therein the through-holes 23 and 33.

The curved lower surface 24 of the top collar 20 is formed with a curvature or contour that closely matches the curvature of the upper surface of the fender 12 at the location where the mount assembly is to be installed. Similarly, the curved upper surface 31 of the bottom collar 30 is formed with a curvature or contour that closely matches the curvature of the under surface of the fender 12 so that the two collars can be brought into contact with opposed surfaces of the fender throughout the areas of the lower surface 24 of the top collar 20 and the upper surface 31 of the bottom collar 30. In this manner, the contact area of the mount assembly is made sufficiently large to ensure a strong, stable and rigid connection. In actual practice, the curvatures of the curved surfaces 24 and 31 are selected to match as closely as possible the fender curvature at one or more locations on most vehicles and thus are generic shapes suitable for use with most vehicles. The curvatures are also generic to similar curvatures found at one or more locations on the roofs, trunks and side panels of many if not most vehicles. This is due to the fact that the curvatures or contours of the curved surfaces 24 and 31, while pronounced, are not so severe as to preclude their use on most vehicles.

An electrically conductive tubular connector 40 is provided for connecting together the top and bottom collars 20 and 30 with the fender 12 sandwiched therebetween, as shown in FIG. 3. The tubular connector 40 has an external threaded section 41 at opposite ends thereof and preferably, throughout its length. The outer diameter of the external threaded section 41 determines the diameter of the through-holes 23 and 33, which are dimensioned to permit the tubular connector 40 to slide therethrough while making contact with the walls of the through-holes. In this manner, the tubular connector 40 makes electrical contact with the bottom collar 30 and also with the top collar 20 if made of electrically conductive material. The tubular connector 40 is preferably made of aluminum though may be made of any suitable electrically conductive material.

A hollow sleeve 42 composed of electrically insulative material is inserted axially into, an extends lengthwise along, the tubular connector 40. A center conductor 44 extends axially in the sleeve 42 and terminates at opposite ends in sockets 45*a* and 45*b*. The center conductor 44 may be either rod- or tubular-shaped. The sockets 45*a* and 45*b* are preferably provided with two or more axial slits (not shown) to permit slight radial expansion of the sockets to accommodate therein connector plugs as described below. The tubular connector 40 may be a standard UHF barrel connector having external threads that mate with a standard PL-259 connector (not shown) that can be threaded onto the lower end of the tubular connector 40 and that has a center plug for insertion into the lower socket 45*b*. If necessary, an adapter can be threaded onto the lower end of the tubular conductor 40 to accommodate connectors other than the PL-259 connector. This enables electrical connection of the mount assembly 10 to the two-way radio in the vehicle.

A mounting ring 50 is provided for securing together the parts of the mount assembly 10 and for providing mechanical and electrical connection to the antenna. The mounting ring is made of metal, preferably brass, aluminum or steel. The mounting ring 50 has an internal threaded section 51 having threads that mate with the threads of the external threaded section 41 of the tubular connector 40, thereby enabling the mounting ring 50 to be threaded onto the upper end of the tubular connector 40. The mounting ring 50 also has an external threaded section 52 having threads that match the internal threads of most standard two-way antennae that are commercially sold today. The external threaded section 52 may have threads of any desired size to match the threads of the internal threaded section of the particular antenna being mounted. To enable threading of the mounting ring 50 onto the tubular conductor 40, the top surface of the mounting ring is provided with two or more blind bores 54, 54 that are configured to engage with prongs of a conventional two-prong tool (not shown).

To enable electrical connection of a center contact of the antenna with the mount assembly 10, a center pin 60 is provided. The center pin 60 has an enlarged head 61 that serves as an electrical contact, and a shank 62 constituting a plug of the center pin 60. The plug 62 is dimensioned to be slidably inserted into the upper socket 45*a* of the tubular member 40 so as to make good electrical contact therewith. The center pin 60 may be comprised of any suitable electrically conductive material, such as brass, aluminum, copper, gold or silver.

A fastening member, such as a hexagonal nut 70, is provided for fixing together the parts of the mount assembly 10. The nut 70 has an internal threaded section 71 having threads that mate with the threads of the external threaded section 41 of the tubular connector 40. The nut 70 may be formed of any suitable material, preferably metal.

The manner of installing the mount assembly 10 on the vehicle fender 12 will be described with reference to FIGS. 1 and 3. First, the installer locates a suitable curved surface section on the vehicle that matches as closely as possible the curvature of the top and bottom collars 20 and 30 and, more particularly, closely matches the curvature of the lower surface 24 of the top collar 20 and the curvature of the upper surface 31 of the bottom collar 30. Then an opening 13 is drilled in the fender 12 at the selected location, the diameter of the opening 13 being the same as the outer diameter of the tubular member 40, which is substantially the same as the diameters of the through-holes 23 and 33 formed in the top and bottom collars 20 and 30, respectively.

The top and bottom collars 20 and 30 are then positioned above and below the fender 12 such that the through-holes 23 and 33 of the collars 20 and 30 align with the opening 13 in the fender 12. The tubular connector 40 is then inserted through the aligned through-holes 23 and 33 and opening 13 after which the mounting ring 50 is threaded onto the upper end of the tubular connector 40 until the upper surface of the mounting ring is flush with the upper end of the tubular connector 40, as shown in FIG. 3, thereby holding the parts in place.

The nut 70 is then threaded onto the lower end of the tubular connector 40 and gradually tightened while ensuring that the top and bottom collars 20 and 30 are maintained in proper position. When properly installed, and due to the matching curvatures of the top and bottom collars with the contour of the fender, the flat upper surface 21 of the top collar 20 lies in a horizontal plane H, i.e., parallel to the ground on which the vehicle is situated. The antenna is then attached to the mount assembly 10 by threading the internal threaded section of the antenna onto the external threaded section 52 of the mounting screw 50. When the antenna is fully threaded onto the mounting ring 50, the base of the antenna engages tightly with the flat upper surface 21 of the top collar 20 and the center contact of the antenna is in electrical contact with the center pin 60. When so attached, then antenna extends vertically upwardly in an upright orientation V, perpendicular to the horizontal orientation H of the flat upper surface 21 of the top collar 20.

In this manner, the antenna is securely mounted to the vehicle and extends perpendicularly to the earth, thereby maximizing reception and transmission of radio signals.

Figure 2:
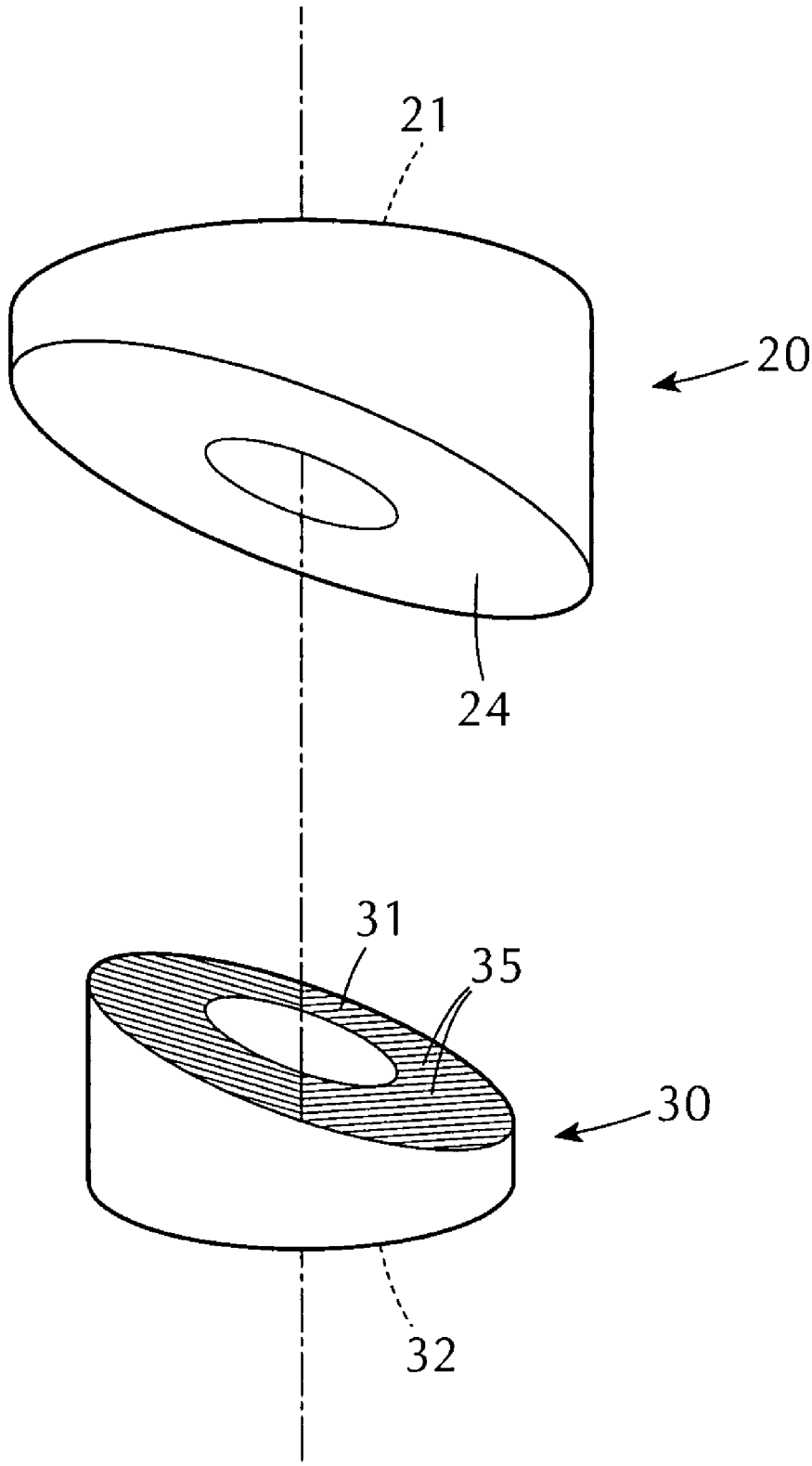
FIG. 2 is a perspective view showing an exemplary configuration of the top and bottom collars.

The top and bottom collars 20 and 30 have sufficiently large opposed surfaces 24 and 31, which sandwich therebetween the fender, to stabilize and strengthen the attachment of the antenna to the fender. As shown in FIG. 2, which is a perspective view of the two collars with the top collar 20 tilted upwardly and the bottom collar 30 tilted downwardly, the surface area of the curved lower surface 24 of the top collar is made larger than the curved upper surface 31 of the bottom collar 30, which helps distribute the weight of the antenna onto the fender of the vehicle. The upper surface 31 of the bottom collar 30 is preferably roughened, such as by machining grooves 35 therein, and the roughened surface enhances electrical connection between the bottom collar and the underside of the fender and also bites into the underside of the fender as the nut 70 is tightened to enhance the gripping action between the bottom collar 30 and the fender 13. The curved lower surface 24 of the top collar 20 and the curved upper surface 31 of the bottom collar 30 provide sufficient contact area with the fender 13 to strengthen and stabilize attachment of the antenna to the fender.

The mount assembly 10 maintains a sealed RF path from the antenna to the coaxial cable that connects to the lower end of the tubular connector 40, and from the coaxial cable to the antenna, thereby minimizing energy loss. The mount assembly 10 provides excellent conductivity for RF signals and aligns the antenna in a straight up-and-down orientation so as to improve reception and transmission of RF signals. The mount assembly 10 has no open areas where RF energy can escape and thus reduces degradation of the radio signals.

Aside from the machined top and bottom collars 20 and 30, the mount assembly 10 can be constructed using standard parts, which may be interchanged with other standard parts to accommodate different connectors for different antennae. The mount assembly 10 may be used with various types of antennae, including without limitation low-band base-loaded antennae, high-band unity gain antennae, high-band high gain antennae, UHF unity gain antennae, UHF high gain antennae, 800 mhz unity gain antennae and 800 mhz high gain antenna.

Though the invention has been described with reference to mounting an antenna on a fender of a vehicle, the invention is not so limited but rather is applicable for mounting antennae to curved surfaces of any type of vehicle, including motor vehicles of all kinds, marine craft, construction vehicles and the like. Though not described herein, it is understood that O-rings, lock nuts and washers and other conventional hardware may be incorporated, as needed, into the mount assembly as will be readily understood by those skilled in the art.

While the invention has been particularly shown and described with reference to preferred examples thereof, it will be understood by those skilled in the art that various changes and modifications in form and details may be made thereto without departing from the spirit and scope of the invention as defined in the appended claims.

I claim:

1. A mount assembly for mounting a radio antenna in an upright orientation on a curved section of a vehicle, the mount assembly comprising:

a top collar disposable during use of the mount assembly on a curved upper surface of a curved section of a vehicle and a bottom collar disposable during use of the mount assembly on a curved under surface of the curved section of a vehicle such that the top and bottom collars sandwich the vehicle curved section therebetween;

the top collar having a flat upper surface, a curved lower surface shaped to match and engage with the curved upper surface of the vehicle curved section, and a through-hole extending therethrough from the upper surface to the lower surface;

the bottom collar having a curved upper surface shaped to match and engage with the curved under surface of the vehicle curved section, a lower surface, and a through-hole extending therethrough from the upper surface to the lower surface;

an electrically conductive tubular connector insertable completely through the through-holes in the top and bottom collars and through an opening in the vehicle curved section, the tubular connector having an external threaded section at least in the regions where the tubular connector extends beyond the upper surface of the top collar and beyond the lower surface of the bottom collar, an electrically insulative sleeve extending axially in the tubular connector, and a center conductor extending axially in the sleeve and electrically insulated from the tubular connector by the sleeve;

a mounting ring having an internal threaded section threadedly engageable with the external threaded section of the tubular connector that extends beyond the upper surface of the top collar so that the mounting ring abuts on the flat upper surface of the top collar, and an external threaded section for threaded engagement with an internal threaded section of a radio antenna; and a fastening member having an internal threaded section threadedly engageable with the external threaded section of the tubular connector that extends beyond the lower surface of the bottom collar, the fastening member coacting with the mounting ring to securely hold together the top collar, the fender and the bottom collar so that the flat upper surface of the top collar has a horizontal orientation and the radio antenna has an upright orientation.

2. A mount assembly according to claim 1; wherein the curved upper surface of the bottom collar is roughened to bite into the under surface of the fender to enhance the gripping action between the bottom collar and the vehicle curved section.

3. A mount assembly according to claim 2; wherein the roughened upper surface of the bottom collar comprises grooves formed in the upper surface of the bottom collar.

4. A mount assembly according to claim 1; wherein the bottom collar is made of electrically conductive material, and the curved upper surface of the bottom collar is roughened to enhance electrical connection between the bottom collar and the curved vehicle section.

5. A mount assembly according to claim 4; wherein the roughened upper surface of the bottom collar comprise grooves formed in the upper surface of the bottom collar.

6. A mount assembly according to claim 1; wherein the top collar is made of high density plastic.

7. A mount assembly according to claim 1; wherein the top collar is made of brass, copper or aluminum.

8. A mount assembly according to claim 1; wherein the center conductor terminates at opposite ends thereof in sockets.

9. A mount assembly according to claim 8; further including an electrically conductive center pin having a plug dimensioned to be inserted into, and make electrical contact with, one of the sockets of the center conductor.

10. In a vehicle having a curved section on which a radio antenna is to be mounted: an antenna mount assembly installed on the vehicle curved section for mounting the radio antenna in an upright orientation, the antenna mount assembly comprising a top collar having a flat upper surface, a curved lower surface in contact with a curved upper surface of the vehicle curved section and having a shape that matches that of the vehicle curved section, and a through-hole extending therethrough from the upper surface to the lower surface;

a bottom collar having a curved upper surface in contact with a curved under surface of the vehicle curved section and having a shape that matches that of the vehicle curved section, a lower surface, and a through-hole extending therethrough from the upper surface to the lower surface;

an electrically conductive tubular connector extending completely through the through-holes in the top and bottom collars and through an opening in the vehicle curved section, the tubular connector having an external threaded section at least in the regions where the tubular connector extends beyond the upper surface of the top collar and beyond the lower surface of the bottom collar, an electrically insulative sleeve extending axially in the tubular connector, and a center conductor extending axially in the sleeve and electrically insulated from the tubular connector by the sleeve;

a mounting ring having an internal threaded section threadedly engaged with the external threaded section of the tubular connector that extends beyond the upper surface of the top collar so that the mounting ring abuts on the flat upper surface of the top collar, and an external threaded section for threaded engagement with an internal threaded section of the radio antenna; and a fastening member having an internal threaded section threadedly engaged with the external threaded section of the tubular connector that extends beyond the lower surface of the bottom collar, the fastening member coacting with the mounting ring to securely hold together the top collar, the vehicle curved section and the bottom collar so that the flat upper surface of the top collar has a horizontal orientation and the radio antenna, when threaded on the mounting ring, has an upright orientation.

11. A vehicle according to claim 10; wherein the curved upper surface of the bottom collar is roughened to bite into the under surface of the vehicle curved section to enhance the gripping action between the bottom collar and the vehicle curved section.

12. A vehicle according to claim 11; wherein the roughened upper surface of the bottom collar comprises grooves formed in the upper surface of the bottom collar.

13. A vehicle according to claim 10; wherein the bottom collar is made of electrically conductive material, and the curved upper surface of the bottom collar is roughened to enhance electrical connection between the bottom collar and the vehicle curved section.

14. A vehicle according to claim 13; wherein the roughened upper surface of the bottom collar comprise grooves formed in the upper surface of the bottom collar.

15. A vehicle according to claim 10; wherein the top collar is made of high density plastic.

16. A vehicle according to claim 10; wherein the top collar is made of brass, copper or aluminum.

17. A vehicle according to claim 10; wherein the center conductor terminates at opposite ends thereof in sockets.

18. A vehicle according to claim 17; further including an electrically conductive center pin having a plug inserted into, and in electrical contact with, an upper one of the sockets of the center conductor.

19. A vehicle according to claim 10; wherein the vehicle is a motor vehicle, and the curved section of the vehicle is a fender of the motor vehicle.

20. A vehicle according to claim 19; wherein the top collar is comprised of plastic and the bottom collar is comprised of brass.

* * * * *